US005107694A

United States Patent [19]

Kemp

[11] Patent Number: 5,107,694

[45] Date of Patent: Apr. 28, 1992

[54] TWISTING APPARATUS

[75] Inventor: Ernest Kemp, Ware, England

[73] Assignee: Helix Reinforcements Limited, England

[21] Appl. No.: 530,763

[22] Filed: May 30, 1990

[30] Foreign Application Priority Data

Jun. 8, 1989 [GB] United Kingdom ..... 8913197

[51] Int. Cl.[5] ..... B21B 15/02

[52] U.S. Cl. ..... 72/64; 72/371

[58] Field of Search ..... 72/64, 371

[56] References Cited

U.S. PATENT DOCUMENTS 486,174 11/1892 Allis ..... 72/64
3,421,351 1/1969 Newman et al. ..... 72/64
3,468,146 9/1969 Newman et al. ..... 72/64
4,601,187 7/1986 Johnson et al. ..... 72/64

FOREIGN PATENT DOCUMENTS 7901194 8/1980 Netherlands ..... 72/64

*Primary Examiner*—David Jones
*Attorney, Agent, or Firm*—Diller, Ramik & Wright

[57] ABSTRACT

Apparatus for twisting a strip of flat material into a helix or other suitable shape comprising one or more feed rollers adapted to feed the strip in to means for guiding and locating the strip in the plane of its longitudinal axis, and from whence the strip passes into twist rolls which are angularly rotatable with respect to the guide means and which are provided with surfaces which grip the strip and when so angularly rotated twist the strip about its longitudinal axis.

10 Claims, 2 Drawing Sheets

TWISTING APPARATUS

BACKGROUND OF THE INVENTION

This invention relates to apparatus for twisting a strip of flat material into a helix or other suitable shape.

According to the present invention such apparatus comprises one or more feed rollers adapted to feed the strip into means for guiding and locating the strip in the plane of its longitudinal axis, and from whence the strip passes into twist rolls which are angularly rotatable with respect to the guide means and which are provided with surfaces which grip the strip and when so angularly rotated twist the strip about its longitudinal axis.

The twist rolls are preferably non-driven and the feed rollers feed the strip through the whole of the apparatus.

The means for guiding and locating the strip comprise guide wheels. These are preferably provided by two wheels on parallel spaced apart axes and which have flanged edges the arrangement being such that the strip is rigidly located and guided between the rolls, and their flanged edges.

The twist rolls are preferably in close proximity to the wheels and comprise in turn two wheels on parallel spaced apart axes in each of which has a flange on one side which in combination with a chamfered portion engages the faces of the strip, the flange and chamfered portion on one wheel being opposite to that on the other wheel. Each wheel is also preferably provided with a cylindrical portion which is engaged by or closely abuts the flanges on the other wheel.

The strip may be engaged at its faces or sides by the cylindrical portions.

The guide wheels and twist wheels are preferably located in a housing which is formed in two parts, the guide wheels being located in a part which is fixed while the twist rolls are located in a part which is angularly rotatable with respect to the fixed part. The degree of rotation preferably determines the pitch of the twist.

The invention may be performed in various ways and one specific embodiment will now be described by way of example with reference to the accompanying drawings in which:

DESCRIPTION OF THE PREFERRED EMBODIMENTS

Figures 1, 5:
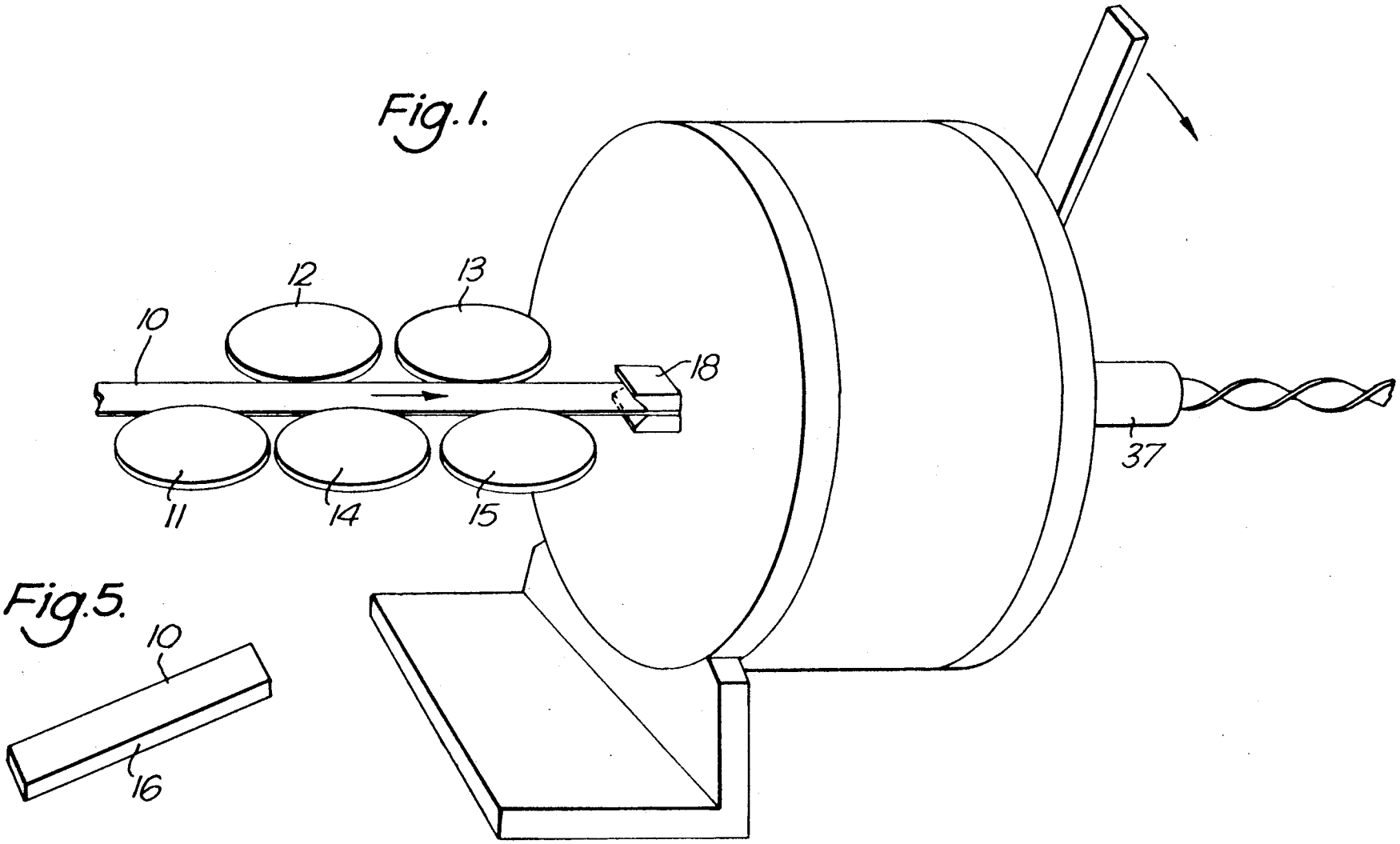
FIG. 1 is a general view of apparatus according to the present invention
FIG. 4 is a side view of the rolls shown in FIG. 2 and which are adapted to twist the material and FIG. 5 is a view of the strip prior to twisting.

As shown in FIG. 1 a strip, such as that shown in FIG. 5 is received from a coil (not shown) and is fed through pinch wheels 11, 12, 13, 14 and 15. These are shown somewhat diagrammatically but the arrangement is such that they are synchronously driven and engage the sides 16 of the strip 10 and drive it through the whole of the apparatus as described hereafter.

From the pinch wheels the strip is fed into a helix generator 17 through an entry guide slot 18. The helix generator 17 is formed as a two part housing, the parts 20 and 21 of which are rotatable with respect to another as more fully described hereafter.

Figure 3:
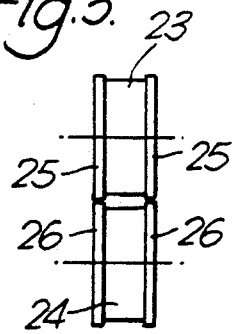
FIG. 3 is a side view, of the entry guide wheels shown in FIG. 2

The strip 10 passes through entry guide 18 in part 20 into a circular cross section chamber 22 and in which are located free wheeling guide wheels 23 and 24 having flanged edges 25 and 26 as shown more clearly in FIG. 3 and which serve to locate and guide the strip.

Figure 4:
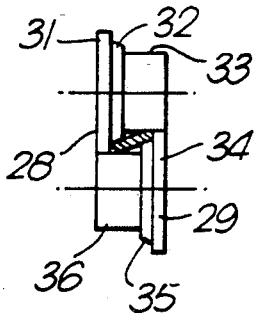

From guide wheels 23 and 24 the strip then passes into a chamber 27 corresponding to chamber 22 in part 21 in which are located wheels 28 and 29, also free-wheeling, adapted to twist the strip into a helical shape. The wheels 28 and 29 are shown more clearly in FIG. 4 and have an outer flange 31 on wheel 28 and stepped down from which is a chamfered portion 32, and stepped down from which is a cylindrical portion 33. On wheel 29 is located, but in the opposite sense, corresponding flange 34, stepped down chamfered portion 35 and cylindrical portion 36. The strip 10 will be located as shown during twisting.

An exit guide 37 is provided through which the strip passes after leaving wheels 28 and 29.

As mentioned above part 21 is angularly rotatable with respect to part 20. To this end the parts 20 and 21 are provided with annular recesses 40, 41 respectively in their outer circumference in which is located a collar 42 held rigid with part 20 by suitable means such as bolts which also pass through retaining ring 43 which in turn holds part 21 in position. The part 21 has an operating handle 44 by means of which it can be rotated with respect to part 20.

Figure 2:
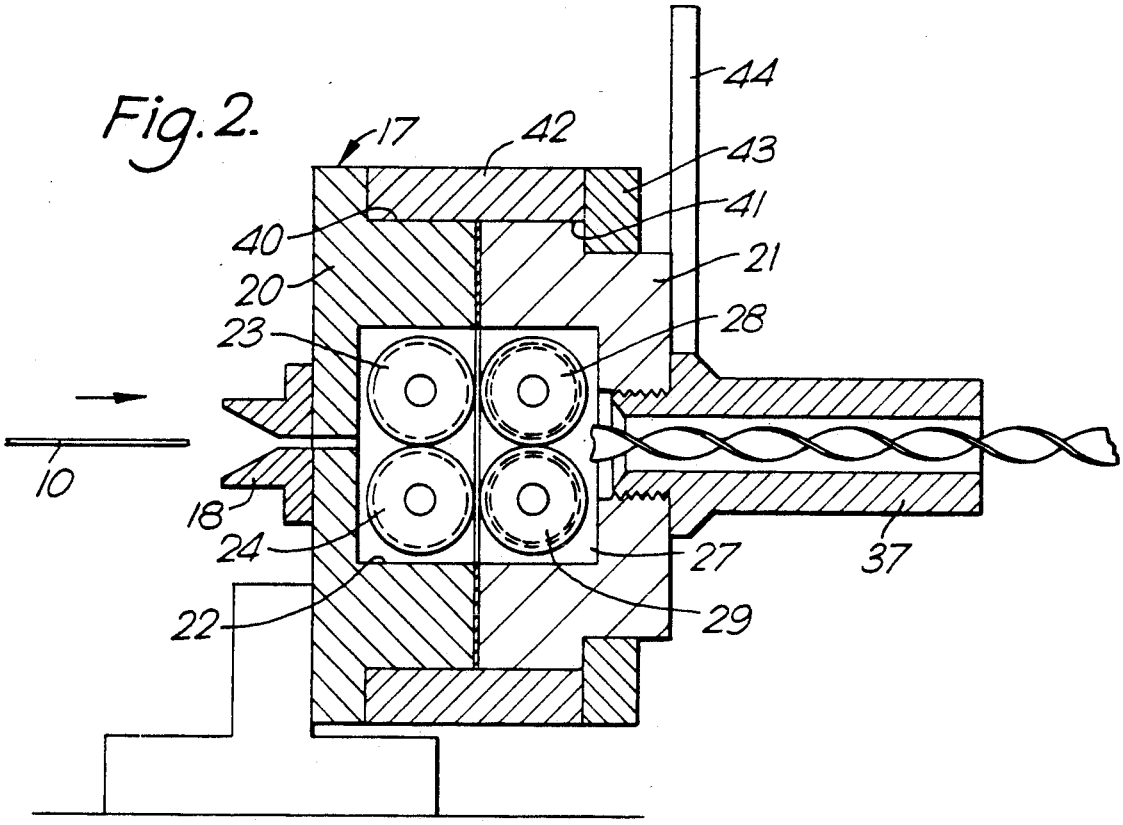
FIG. 2 is a cross section through the apparatus of FIG. 1

In operation in order to start up the apparatus the strip 10 is fed from the coil through pinch wheels 11, 12, 13, 14 and 15 guide 18, guide rolls 23 and 24, and wheels 28 and 29, which during the starting up operation are in the position shown in FIG. 2 that is parallel to rolls 23 and 24. In this position the strip will pass into the exit guide 37 unchanged.

In order to obtain a twist in the strip part 21 is rotated angularly by means of operating handle 44 with respect to part 20. The degree of rotation determines the pitch of the helix produced and the way in which the apparatus operates is shown more clearly in FIG. 4. In this the opposite sides of the strip are caused to bear against the chamfers 32 and 35 whilst the sides of the strip are constrained by the flanges 31 and 34 and cylindrical portions 33 and 36.

The wheels 28 and 29 when so formed provide a simple and effective method of obtaining a twisted strip from a flat strip. They are particularly suitable for materials such as stainless steel which are not readily deformable.

I claim:

1. Apparatus for twisting a strip of flat material into a helix or other suitable shape comprising one or more feed rollers adapted to feed the strip into means for guiding and locating the strip in the plane of its longitudinal axis, and from whence the strip passes into twist rolls which are angularly rotatable with respect to the guide means and which are provided with surfaces which grip the strip and when so angularly rotated twist the strip about its longitudinal axis, the twist rolls are non-driven and the feed rollers feed the strip through the whole of the apparatus, the means for guiding and locating the strip comprise guide wheels, the guide wheels comprise two wheels on parallel spaced apart axes and which have flanged edges, and the arrangement being such that the strip is rigidly located and guided between the guide wheels, and their flanged edges.

2. Apparatus as claimed in claim 1, in which the twist rolls are in close proximity to the guide wheels.

3. Apparatus as claimed in claim 1, in which the guide wheels and twist rolls are located in a housing which is formed in two parts, the guide wheels being located in a part which is fixed while the twist rolls are located in a part which is angularly rotatable with respect to the fixed part.

4. Apparatus as claimed in claim 1, in which the twist rolls comprise two twist wheels on parallel spaced apart axes and each of which has a flange on one side which in combination with a chamfered portion engages the faces of the strip, the flange and chamfered portion on one twist wheel being opposite to that on the other twist wheel.

5. Apparatus as claimed in claim 4, in which the guide wheels and twist wheels are located in a housing which is formed in two parts, the guide wheels being located in a part which is fixed while the twist-wheels are located in a part which is angularly rotatable with respect to the fixed part.

6. Apparatus as claimed in claim 4, in which each twist wheel is also provided with a cylindrical portion which is engaged by or closely abuts the flanges on the other twist wheel.

7. Apparatus as claimed in claim 6, in which the guide wheels and twist wheels are located in a housing which is formed in two parts, the guide wheels being located in a part which is fixed while the twist wheels are located in a part which is angularly rotatable with respect to the fixed part.

8. Apparatus as claimed in cl aim 6, in which the strip is engaged at its faces or sides by the cylindrical portion of the twist wheel.

9. Apparatus as claimed in claim 8, in which the guide wheels and twist wheels are located in a housing which is formed in two parts, the guide wheels being located in a part which is fixed while the twist wheels are located in a part which is angularly rotatable with respect to the fixed part.

10. Apparatus for twisting a strip of flat material into a helix or other suitable shape comprising one or more feed rollers adapted to feed the strip into means for guiding and locating the strip in the plane of its longitudinal axis, and from whence the strip passes into twist rolls which are angularly rotatable with respect to the guide means and which are provided with surfaces which grip the strip and when so angularly rotated twist the strip about its longitudinal axis, the twist rolls are non-driven and the feed rollers feed the strip through the whole of the apparatus, the means for guiding and locating the strip comprise guide wheels said guide wheels and twist rolls are located in a housing which is formed in two parts, the guide wheels being located in a part which is fixed while the twist rolls are located in a part which is angularly rotatable with respect to the fixed part.

* * * * *